United States Patent [19]

Patteson et al.

[11] Patent Number: 4,995,763

[45] Date of Patent: Feb. 26, 1991

[54] OFFSHORE WELL SYSTEM AND METHOD

[75] Inventors: R. Mark Patteson, Houston; Samuel C. Lynch, Montgomery, both of Tex.

[73] Assignee: Atlantic Richfield Company, Los Angeles, Calif.

[21] Appl. No.: 471,191

[22] Filed: Jan. 26, 1990

[51] Int. Cl.[5] ..... E02B 17/00; F16L 21/00

[52] U.S. Cl. ..... 405/195; 166/368; 285/141

[58] Field of Search ..... 405/195, 202, 224, 169, 405/170, 171; 166/382, 368, 338; 285/141, 142, 143

[56] References Cited

U.S. PATENT DOCUMENTS

| | | | |
|---|---|---|---|
| 3,468,559 | 9/1969 | Ahlstone | 285/142 X |
| 3,881,549 | 5/1975 | Thomas | 166/357 |
| 4,367,982 | 1/1983 | Hubbard | 405/202 |
| 4,550,782 | 11/1985 | Lawson | 285/141 X |
| 4,710,061 | 12/1987 | Blair et al. | 405/195 |
| 4,751,968 | 6/1988 | Ames et al. | 166/368 |

*Primary Examiner*—Dennis L. Taylor

*Attorney, Agent, or Firm*—Michael E. Martin

[57] ABSTRACT

A freestanding offshore well structure includes a generally cylindrical caisson having a relatively small diameter drivepipe section connected to a larger diameter caisson section which is of sufficient strength to withstand wind and wave action. An upper portion of the drivepipe section is provided with a landing ring for a hanger for a conductor casing string or a wellhead body for a surface pipe string. A casing connector or nipple supports a diverter above the landing ring. The caisson is driven to refusal, the diverter attached to the upper end of the caisson and drilling operations and installation of the casing string, surface pipe and wellhead body are carried out through the diverter. The diverter is then removed and connection of wellhead valve bodies, handles and associated conduits to the wellhead is then carried out to complete the well assembly.

12 Claims, 1 Drawing Sheet

OFFSHORE WELL SYSTEM AND METHOD

BACKGROUND OF THE INVENTION

1. Field of the Invention

The present invention pertains to an offshore well structure including a support caisson and wellhead assembly and a method of installing the caisson and wellhead assembly.

2. Background

In the installation of offshore oil and gas wells in relatively shallow waters conventional practice includes, initially, installing a so-called drivepipe which is driven to refusal. The well is then drilled and, if it is successful, it is completed. After the well completion a supporting caisson is over-driven around the drivepipe before the drilling rig is moved off of the drill site. The caisson and the drivepipe or the wellhead assembly are suitably inter-connected and the caisson serves as a support structure which is sufficiently strong to withstand wind and wave action against the free standing drivepipe and casing arrangement. U.S. Pat. No. 4,710,061 to C. R. Blair et al and assigned to the assignee of the present invention discloses typical prior ar offshore well structures.

Prior art practice has also required several steps in installing and removing a device known as a diverter with respect to the drivepipe during each stage of drilling to permit the installation of casing strings of progressively smaller diameter. The prior art practice also, of course, requires the final step of overdriving the protective caisson after the well is completed. Considering the high cost of drilling and completing oil and gas wells, including offshore wells in particular, there has been a continuing desire to reduce the number of components required for the well installation as well as the time required to drill and complete the well. The present invention is directed to an improved offshore wellhead system of the so-called free standing type as well as an improved method for installing same.

SUMMARY OF THE INVENTION

The present invention provides an improved free standing offshore well system and a method of providing same and wherein the well includes a combination drivepipe or outer casing and caisson which is of a sufficiently large diameter to withstand wind and wave action.

In accordance with an important aspect of the present invention an offshore well system is provided wherein a combination drivepipe and outer caisson includes or is connected to a landing ring or surface for supporting a casing hanger or wellhead body member which in turn provides for supporting a wellhead. Both the casing hanger and the wellhead are installed, as required, through a diverter member while the diverter is connected to the outer upper end of the combined drivepipe-caisson. The upper end of the drivepipe or landing ring member may also be provided with one or more ports for the circulation of cement or wellbore fluids or for the injection of cement into the annulus between the drivepipe and casing or conductor pipe.

In accordance with another important aspect of the present invention there is provided an improved method for installing an offshore well system wherein, after driving of a combination drivepipe and caisson member a diverter assembly is connected to or supported by the drivepipe and one or more pipe or casing strings and associated hangers or wellhead members are inserted through the diverter member and supported by the drivepipe without requiring removal of the diverter member until after the wellhead assembly has been installed.

Those skilled in the art will recognize the above described features and advantages of the present invention together with another superior aspects thereof upon reading the detailed description which follows in conjunction with the drawing.

DESCRIPTION OF PREFERRED EMBODIMENTS

Figure 3:
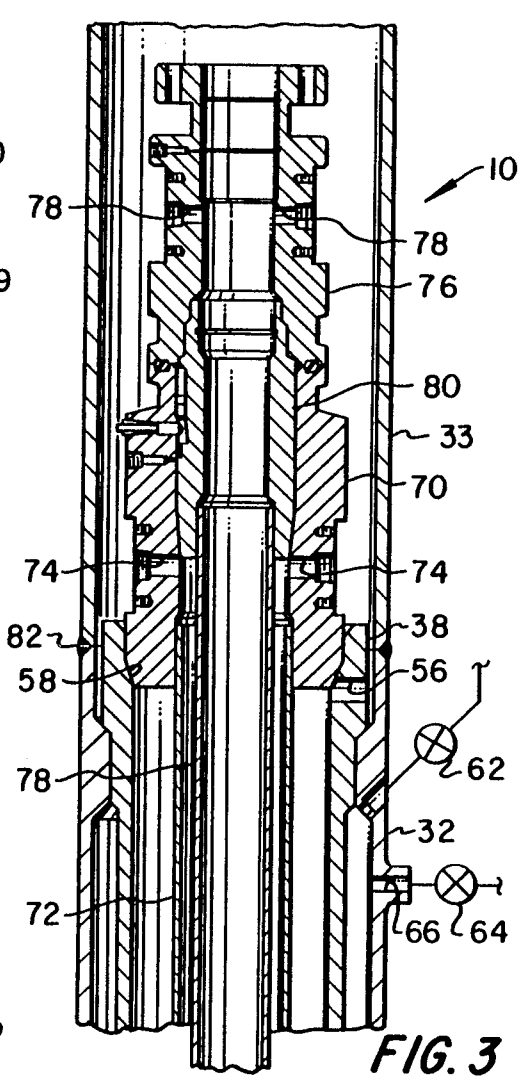
FIG. 3 is a vertical central section view of a wellhead installed within the casing or conductor pipe and supported by a casing hanger, which in turn is supported by the drivepipe landing surface.

In the description which follows, like parts are marked throughout the specification and drawing with the same reference numerals, respectively. The drawing figures are not necessarily to scale and certain components are shown in somewhat generalized or schematic form in the interest of clarity and conciseness.

Figure 1:
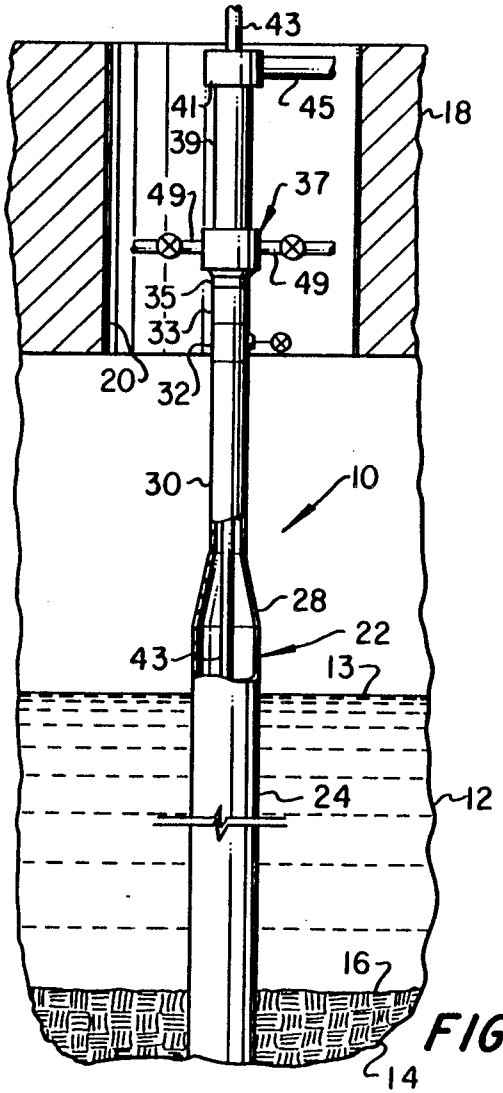
FIG. 1 is a side elevation in somewhat schematic form of a well system being installed in accordance with the present invention.

Referring to FIG. 1, there is illustrated an offshore well !0 in accordance with the present invention and in the process of being drilled utilizing a unique free standing support structure. The well 10 is shown being developed in a body of water 12 overlying a subterranean formation 14 having a mudline or interface with the body of water, as indicated by the numeral 16. A drilling rig or other work platform 18 overlies the body of water 12 and is supported by suitable structure, not shown. The rig 18 includes a work-bay or moon-pool 20 for accommodating a portion of the well structure including certain components used in drilling the well 10.

Figure 2:
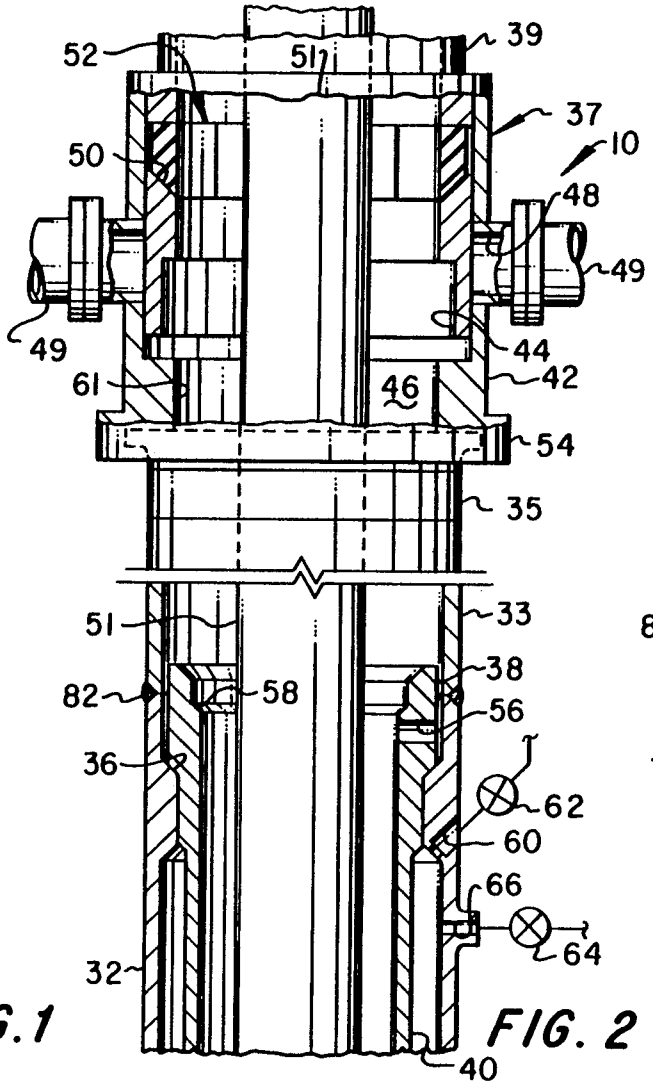
FIG. 2 detail elevation, partially sectioned, of the drivepipe supported landing ring or member and a diverter supported thereon.

The well 10 includes a support member of unique configuration comprising a combination drivepipe and support caisson, generally designated by the numeral 22. The support member 22 includes a relatively large diameter cylindrical caisson part 24 which extends from just above the surface 13 of the body of water 12 to a suitable point below the mudline 16 at which the formation 14 has refused to accept further extension of the caisson upon the driving of same by a suitable pile driver or the like, not shown. The support member 22 includes a generally conical transition portion 28 between the caisson part 24 and a generally cylindrical tubular drivepipe part 30, extending upward from the transition portion to a point just below or within the moon-pool 20. A second support member comprising an extension of the drivepipe 30 is suitably connected thereto, such by welding, and is generally designated by the numeral 32. As shown in FIG. 2, the support member 32 includes a portion 34 which forms a ringlike landing surface 36 for a casing hanger 38. The hanger 38 is suitably formed with or connected to an elongated casing or so-called conductor pipe string 40.

The support member 32 also supports thereabove a suitable pipe extension or nipple member 33 which is connected to a connector member 35 for connecting thereto a commercially available device known in the art as diverter, generally designated by the numeral 37. A further extension pipe member or nipple 39 extends above the diverter 37 and is connected to a drilling mud collector member 41 whereby drilling mud may be conducted upward through the annular areas within the caisson part 24 and the drivepipe part 30, between these parts and an elongated drill pipe 43 which is shown extending down through the support member 22 in FIG. 1. Drilling fluid is conducted away from the collector member 41 by way of a conduit 45 to a suitable recirculation system, not shown. Means for driving the drill pipe 43 and for conducting the drilling fluid between the conduit 45 and the interior of the drill pipe 43 are of conventional design and are not believed to require further description or illustration herein.

Referring further to FIG. 2, the diverter 37 may be of conventional construction and, by way of example, includes a housing 42 which supports a sliding piston member 44. The piston member 44, in the position illustrated in FIG. 2, normally blocks the flow of fluid from a space 46 formed between the diverter housing 42 and a drill pipe 51 to exit ports 48 formed in the housing. In FIG. 2, the drill pipe 51 is shown replacing the drill pipe 43 since a smaller diameter portion of the wellbore is being drilled pursuant to installation of the casing 40. The piston 44 also includes a camming surface 50 formed thereon which engages a resilient, segmented closure member, generally designated by the numeral 52. In response to upward sliding movement of the piston 44 the closure member 52 is moved radially inwardly into engagement with the outer surface of the drill pipe 51. In the event of an over-pressure condition or undesirable high flow of drilling fluid up through the space 46, the piston 44 may be shifted to a position to effect closure of the normal flow path of fluid and cause a diversion of the fluid through the ports 48 and conduits 49 until normal drilling conditions can be restored. The diverter 37 may be of a type commercially available such as a type manufactured under the trade mark HYDRIL by the Hydril Corporation, Houston, Texas. The diverter 37 maybe provided with a mechanical connecting part 54 for connection to the connector member 35 or the diverter may be suitably welded to the member 33 in a conventional manner.

FIG. 2, illustrates the casing string 40 already installed through the diverter 37. The hanger 38 preferably includes a suitable passage 56 to provide for the flow of fluid through an annular area above the hanger which will be formed when a wellhead member is installed on and supported by surface means 58 formed on the interior of the hanger 38, as illustrated. Moreover, in some instances it may be necessary to inject cement or grout material into the annular area between the casing 40 and the drivepipe 32. In this regard grouting ports 60, one shown, are formed in the member 32 which may be accessed through suitable valves 62 for conducting fluids or cement slurries between the exterior of the member 32 and the annulus formed between the members 22 and 32 and the casing string 40. In like manner a drain valve 64, connected to a suitable port 66, may also be installed on the drivepipe member 32 for draining fluids and cement slurries from the aforementioned annular area.

Those skilled in the art will appreciate that additional drilling may be conducted and wellhead members and/or casing hangers installed in progressive fashion, all done through the diverter member 37, as long as the outer diameters of these members permit access to the interior of the member 33 through the diverter interior space. In fact, the limiting, minimum diameter may be formed by the bore 61 in the housing 42 or, conversely, by certain internal components such as the piston member 44 or the interior surfaces of the closure member 52. In all events, as long as the diverter 37 is selected to be of a large enough interior diameter to permit insertion of casing hangers, wellhead components and the like therethrough, the operations described herein may be carried out without removing the diverter from the well structure. In some instances, as illustrated in FIG. 3, it may be necessary to remove wellhead components such as flow-line valve bodies and handles, not shown, from the wellhead members but these may be re-installed as will be described hereinbelow.

Referring now further to FIG. 3, there is illustrated what is essentially the completion of the well 10 by the installation of a wellhead body 70 which is landed on the surface 58 of the casing hanger 38 and has connected thereto a casing string 72. As will be noted viewing FIG. 3, fluid conducting ports 74 in the wellhead body 70 are illustrated sans the associated valve bodies and handles which would be connected to the body 70 in the final process of completing the well 10. FIG. 3 also illustrates the installation of a second wellhead body 76 having suitable fluid conducting ports 78 formed therein and wherein the body 76 is also absent its valve bodies and handles which are installed after removal of the member 33 from the member 32. Conventional clamp type connections may be made between the bodies 70 and 76. A mandrel type hanger member 80 is illustrated extending into the body 70 in suitable supporting relationship to a third casing string 78 extending within the casing string 72. As previously indicated, the casing strings 72 and 78 together with their associated wellhead bodies 70 and 76, respectively, are installed and landed for support by the hanger member 38 and the member 32 through the diverter 37. FIG. 3, does not illustrate the final installation of a tubing string and support hanger together with such components as safety valves and a wellhead bonnet. However, the installation of these members may be carried out in a conventional manner and with installation of the body 76.

After the wellhead is installed the diverter 37 and the members 35 and 33 are removed from the member 32. For example, the assembly of the diverter 37, the member 35 and the member 33 may be removed by cutting the member 33 from the member 32 at its initial weld point 82, FIGS. 2 and 3. Alternatively, the connection between the member 33 and the member 32 may be of a quick release type, not shown, but commonly used for oil field conduit connections. After disconnecting the diverter 37 and the members 35 and 33, suitable wellhead valve bodies and associated operating mechanism may be installed on the body members 70 and 76, and the piping, not shown, normally associated with a wellhead may be connected thereto.

As will be appreciated from the foregoing description, the wellhead system of the present invention allows the running of one or more hangers and wellhead bodies and an associated casing or tubing string through the diverter 37. The system also provides for the liner hangers and wellhead bodies to be supported by a landing surface or ring formed on the upper end of a combination drivepipe and support caisson. Such operation provides timesavings on installation of these components and also allows all of the casing strings to be set in tension as compared with the conventional practice of cutting the top of a casing and then attaching a wellhead body thereto with the casing in a relaxed state.

Those skilled in the art will readily appreciate from the foregoing description that a improved offshore well system or assembly and a method of installation are provided by the present invention. As previously mentioned, the landing surface 36 may be formed on a separate part such as the member 32 and secured to the drivepipe 30, or the upper end of the drivepipe 30 may be modified by the insertion of a ring which provides the profile of the surface 36 for receipt of the casing hanger 38. A landing ring which forms the surface 36 or a point on the member 32 adjacent the surface 36 may be provided with a sight port for viewing when the hanger member 38 has been properly landed on the surface 36. The liner hanger 38 and the casing string 40 can be run into position with conventional drill pipe running tools or full bore running tools which match the casing size. The connections which are shown as welded connections or are not otherwise described may also be formed by other types of connectors such as one of the so-called quick release type commonly used in connection with oil field wellhead equipment.

Although a preferred embodiment of an offshore well system or assembly and a method of installation have been described herein those skilled in the art will also recognize that various other substitutions and modifications may be made without departing from the scope and spirit of the invention as recited in the appended claims.

What is claimed is:

1. An offshore well system for conducting fluids between a point above the surface of a body of water and a point within a subterranean formation below said body of water comprising:

an elongated combination drivepipe and caisson extending from said formation to a point above the water surface:

means forming a landing surface near an upper end of said caisson, at least a first casing string disposed within said caisson, said first casing string including means forming a casing hanger at an upper end thereof and cooperable with said means forming said landing surface for suspending said casing string in said caisson, a wellbore fluid diverter secured to said caisson at a point above said landing surface and having an internal diameter large enough to permit insertion of said first casing string and said hanger through said diverter for landing said hanger on said landing surface; and a wellhead body having an elongated pipe string connected thereto and insertable through said diverter for landing on a surface formed on said casing hanger.

2. The well system set forth in claim 1, wherein:

said caisson includes a first part extending within said body of water and into said formation, said first part being of cylindrical cross-sectional configuration and being of sufficient diameter to withstand wind and wave loading imposed thereon; and a second part connected to said first part and extending above said water surface and being of a cylindrical cross-sectional configuration of a diameter less than said first part.

3. The well system set forth in claim 1, wherein:

said caisson includes port means form therein for communicating fluids between the interior of said caisson and the exterior of said caisson, said port means opening into said caisson at a point between said landing surface and said formation.

4. The well system set forth in claim 2, including:

a tapered section of said caisson interconnecting said first part and said second part.

5. An offshore well system for installation in a body of water and extending into a formation below said body of water, said well system including;

an elongated generally cylindrical caisson including a first part extending substantially through said body of water and into said formation and being of a relatively large diameter, a generally conical transition piece connected to an upper end of said first part and a second part extending above and connected to said transition piece and being of a generally cylindrical configuration and of a diameter less than said first part;

means forming a landing surface connected to said second part and supported thereby; and hanger means connected to an elongated conduit string extending within said caisson, said hanger means including a surface thereon cooperable with said landing surface for supporting said conduit string within said caisson.

6. The well system set forth in claim 5, wherein:

said hanger means includes a wellhead body.

7. A method for installing an offshore well to provide a substantially freestanding wellhead support including the steps of:

providing an elongated generally cylindrical caisson having a first part for extension substantially through a body of water and into a formation below said body of water, a second part extending above said body of water and landing surface means for supporting a wellhead;

driving said caisson into said formation;

providing a wellbore fluid flow diverter and connecting said diverter to an upper end of said second part:

drilling a first wellbore portion with drill pipe extending through said diverter and said caisson;

providing an elongated first casing string including hanger means at an upper end of said first casing string engageable with said landing surface means on said caisson;

inserting said first casing string and said hanger mean into the interior of said caisson through said diverter; and landing said hanger means on said landing surface.

8. The method set forth in claim 7 including the steps of:

drilling a further portion of said wellbore with drill pipe of a diameter less than the diameter of said first casing string;

providing a second casing string including wellhead body means engageable with said hanger means of said first casing string;

installing said second casing string through said diverter into said wellbore with said wellhead body means in registration with and supported by said hanger means.

9. The method set forth in claim 8 including the step of:

disconnecting said diverter assembly from said caisson.

10. The method set forth in claim 7, including the step of:

injecting cement into said wellbore through said first casing string and conducting fluid away from said well through an annular space between said caisson and said first casing string.

11. The method set forth in claim 7, including the step of:

injecting cement into an annular space formed between said caisson and said first casing string.

12. A method for installing an offshore well to provide a substantially freestanding wellhead support including the steps of:

providing an elongated generally cylindrical caisson having a first part for extension substantially through a body of water and into a formation below said body of water, a second part of a diameter less than said first part extending above said body of water and landing surface means connected to said second part for supporting a wellhead;

driving said caisson into said formation;

providing a wellbore fluid flow diverter and connecting said diverter to an upper end of said second part;

drilling a first wellbore portion with drill pipe extending through said diverter and said caisson;

providing an elongated conduit string including hanger means at an upper end of said conduit string engageable with said landing surface means;

inserting said conduit string and said hanger means into the interior of said caisson through said diverter;

landing said hanger means on said landing surface means; and disconnecting said diverter from said caisson.

* * * * *